United States Patent [19]

Pratt et al.

[11] Patent Number: 4,486,744

[45] Date of Patent: Dec. 4, 1984

[54] MAXIMUM AND MINIMUM GAS FLOW SENSOR

[75] Inventors: Richard L. Pratt, Shelburne; Francis J. Thornton, Charlotte, both of Vt.

[73] Assignee: International Business Machines Corporation, Armonk, N.Y.

[21] Appl. No.: 405,211

[22] Filed: Aug. 4, 1982

[51] Int. Cl.[3] ..... G08B 21/00

[52] U.S. Cl. ..... 340/606; 73/861.56; 73/861.57; 73/322.5; 200/81.9 R; 200/84 B; 340/611

[58] Field of Search ..... 340/606, 607, 617, 618, 340/620, 611; 200/84 R, 81.9 R, 61.52, 84 B; 73/861.55, 861.56, 304 C, 308, 313, 322.5, 861.57; 324/61 P, 61 R, 61 EC

[56] References Cited

U.S. PATENT DOCUMENTS

| | | | |
|---|---|---|---|
| 487,634 | 12/1892 | McDermott | 200/84 R |
| 849,707 | 4/1907 | Willms | 73/322.5 |
| 3,024,655 | 3/1962 | Dwyer et al. | 73/861.55 |
| 3,342,138 | 9/1967 | Parks et al. | 340/618 X |
| 3,390,326 | 6/1968 | Imadate | 324/61 EC |
| 3,689,908 | 9/1972 | Ray | 73/861.56 |
| 3,816,680 | 6/1974 | Suzuki et al. | 200/61.52 X |
| 4,308,725 | 1/1982 | Chiyoda | 200/84 R X |

FOREIGN PATENT DOCUMENTS

| | | | |
|---|---|---|---|
| 29634 | 8/1907 | Austria | 200/84 R |

OTHER PUBLICATIONS

IBM Technical Disclosure Bulletin, vol. 25, No. 7A; Dec. 1982; "Air Filter Clog Sensor" by Dunn et al.; pp. 3519–3520.

*Primary Examiner*—James L. Rowland
*Assistant Examiner*—Daniel Myer
*Attorney, Agent, or Firm*—Theodore E. Galanthay; William N. Hogg

[57] ABSTRACT

A device for indicating the flow of gases includes a vertically extending conduit section in which is disposed a ball. The ball seats on a lower seat at zero or minimum gas flow, and on an upper seat at maximum sensed gas flow. The upper seat is configured to permit essentially unrestricted gas flow when the ball is seated on it.

Electrical means are associated with either the bottom seat and/or the top seat and co-acts with the ball to sense either minimum gas flow or maximum gas flow, and generate a signal responsive thereto.

9 Claims, 6 Drawing Figures

MAXIMUM AND MINIMUM GAS FLOW SENSOR

BACKGROUND OF THE INVENTION

This invention relates to sensing devices, and more particularly to gas flow sensing devices. This invention is particularly directed to a gas flow sensing device that indicates one or more selected rates of gas flow, yet at a maximum sensed flow will not substantially restrict the gas flow and thereby cause undesirable back pressure.

There are many applications wherein it is necessary to sense the flow of gas, often these situations require the sensing of either a no flow or maximum flow condition. For example, in venting certain gases to the ambient, it is often necessary to know if there is any flow at all, and also to know if the flow has reached or exceeded a certain selected maximum permissible rate. This sensing also often must be done with respect to a corrosive or explosive gas.

SUMMARY OF THE INVENTION

According to the present invention a method and device for indicating gas flow through a conduit is provided. The device includes a section of vertically extending conduit in which a ball is disposed. There is lower seating means for the ball at zero gas flow and upper seating means for the ball at maximum gas flow. The upper seating means is configured to permit essentially unrestricted flow when the ball is seated thereon. Electrical means are associated with at least a portion of the section to generate an electrical signal responsiveness to coaction with the ball being at a given location with respect to said electrical means.

DESCRIPTION OF THE PREFERRED EMBODIMENTS

Figure 1:
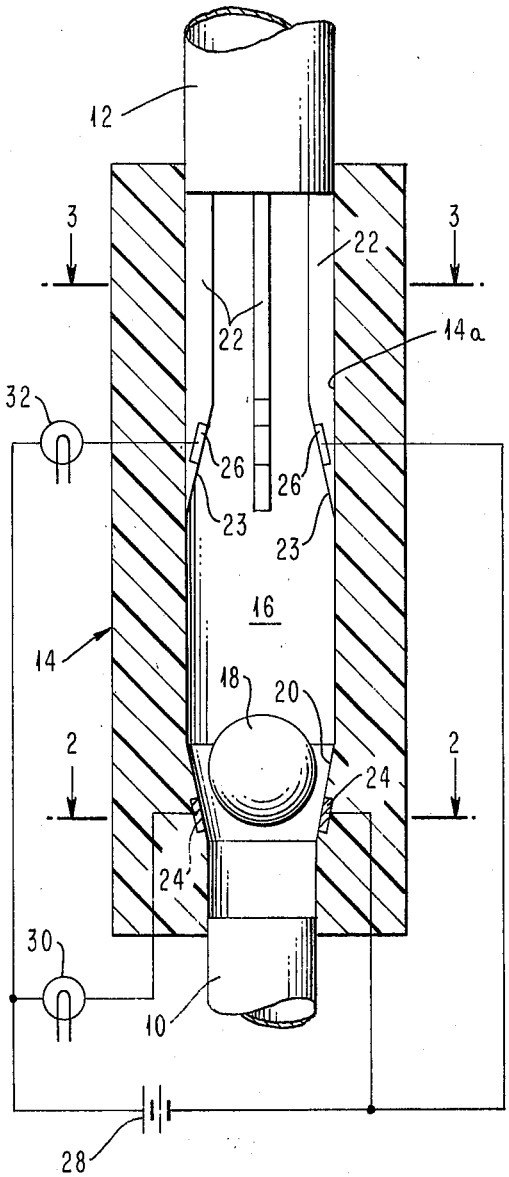
FIG. 1 is a longitudinal sectional view of one embodiment of a gas flow indicator according to this invention.
Figure 3:
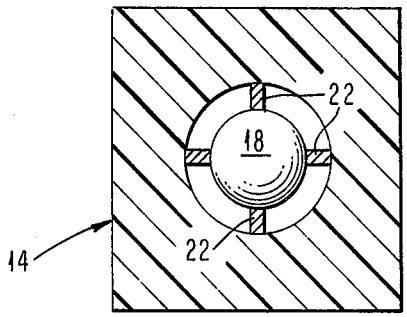
FIG. 3 is a sectional view taken substantially along the plane designated by the line 3—3 of FIG. 1.
Figure 2:
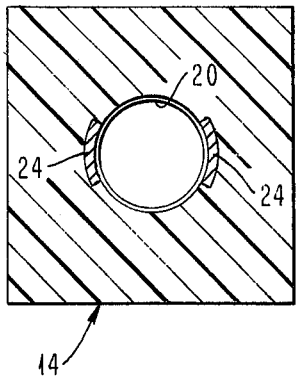
FIG. 2 is a sectional view taken substantially along the plane designated by the line 2—2 of FIG. 1.

Referring now to the drawing, and for the present to FIG. 1 through 3, one embodiment of a device for indicating gas flow levels according to this invention is shown. The gas is supplied from a supply conduit 10, and exhausts through an exhaust conduit 12. The device of the present invention includes an enlarged conduit section 14 extending in a generally vertical direction between the conduits 10 and 12, and having a central opening 16. A very light hollow ball 18 is disposed in the opening 16 and is freely movable therein and is responsive to gas flow through the conduit section 14. The ball, which can be a table tennis ball, or the like, is metal coated, for example with gold or aluminum, for a purpose which will be explained presently.

At its lower end the conduit section 14 is conicofrustrum shaped, as shown at 20, which defines a lower seat for the ball 18. Four circumferentially spaced vanes 22 are provided at the upper end of the opening 16 within the conduit 14. The vanes have tapered lower surfaces 23 which form an upper seat for the ball 18.

Disposed on the lower seat 20 are a pair of spaced metal contacts 24. Similar metal contacts 26 are disposed on two of the vanes 22. A battery 28 is connected in circuit relationship with the lower contacts 24 and a lamp 30 and also in circuit relationship with upper contacts 26 and a lamp 32.

To support such contacts the conduit 14 must be made of an insulating material such as plastic, glass, or the like or else the metal contacts must be insulated from the conduit 14.

In operation, at zero gas flow the ball 18 will rest on the lower seat 20 making contact with contacts 24. The metal coating on the ball 18 will complete the circuit between contacts 24, battery 28, and lamp 30 causing lamp 30 to light and indicate a zero flow condition. If desired, the contacts 24 can be formed flush with the seat 20 so that in a zero flow condition the ball 18 can act as a check valve to prevent leakage or back flow.

When gas starts to flow and exceeds a predetermined minimum, based on the weight of the ball, the ball 18 will rise off the contacts 24 breaking the circuit and the lamp 30 will go out. The greater the gas flow rate the higher the ball will rise, until at some predetermined flow rate the ball will seat on the vanes 22 at the taper 23 and make contact with contacts 26. This will complete the circuit between the contacts 26, battery 28 and lamp 32 causing lamp 32 to light indicating a given preselected maximum flow rate. At this given rate at which the ball is at its maximum height, the gas flow will be essentially unrestricted since the vanes are made sufficiently thin so that they do not substantially impede the gas flow.

To assure completely unrestricted gas flow the exhaust conduit 12 and the upper portion of the conduit 14 can be enlarged, such as by tapering outwardly the inner wall of the upper portion of the conduit 14 so that its cross-sectional area, less the cross-sectional area of the ball, is at least equal to or greater than the cross-sectional area of the input conduit 10; that is, when the cross-sectional area of the ring A between the inner wall 14*a* of the conduit 14 and the ball 18 is:

$$A=\pi(R+R_B)(R-R_B)-3(LW)$$

where

R is the radius of the conduit 14

$R_B$ is the radius of the ball 18

L is length of a vane 22

W is the width of a vane 22 and the cross sectional area of the input conduit 10 is $$A_I=\pi R_I^2$$

where, $A_I$ is the area of the inlet conduit $R_I$ is the radius of the inlet conduit Then A must be equal to or greater than $A_I$.

Figure 6:
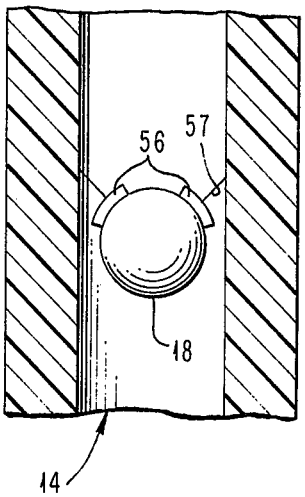
FIG. 6 is a partial longitudinal sectional view of another embodiment of this invention.

The cross-sectional area of the vanes 22 can be substantially reduced, as shown in FIG. 6, by using cup like vanes 56 or sheets formed to be close fitting to the ball, which vanes 56 are supported by thin struts 57 extending from the inner wall 14*a*, to conduit 14. Thus no increased back pressure is generated even at this maximum sensed flow condition, and a warning lamp indicates such a condition.

Figure 4:
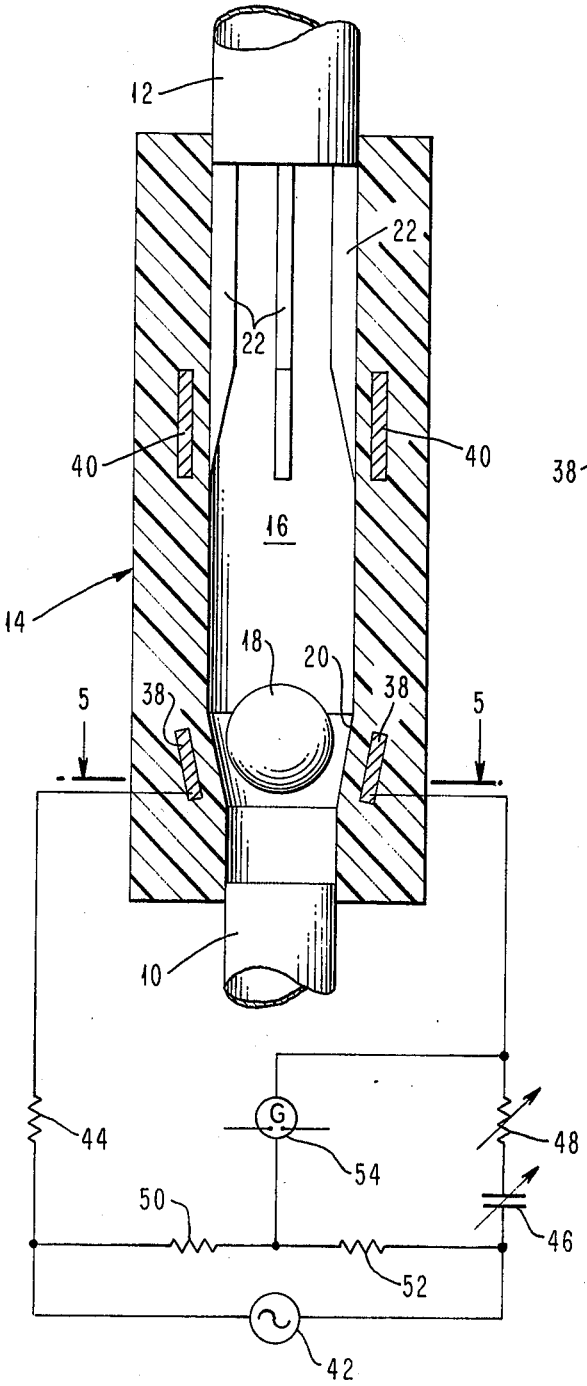
FIG. 4 is a longitudinal sectional view of another embodiment of the device of this invention.
Figure 5:
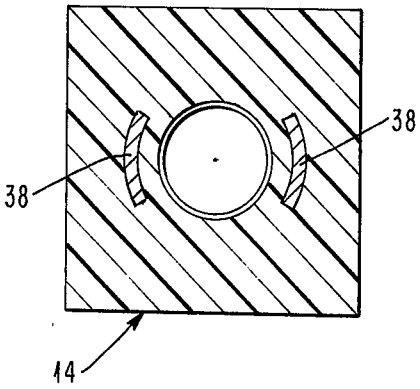
FIG. 5 is a sectional view taken substantially along the plane designated by the line 5—5 of FIG. 4.

Referring now to FIGS. 4 and 5, another embodiment of this invention is shown. This embodiment is for use with explosive gases where sparks cannot be tolerated or with corrosive gases which could damage the contacts and/or the metallic coating on the ball. In this embodiment, instead of lower exposed contacts, a pair of opposing electrodes 38, are embedded beneath the surface of the lower seat 20; also a pair of opposing electrodes 40 are embedded beneath the surface of the conduit adjacent two of the vanes 22. The ball 18 preferably has an insulating protective coating such as an inert plastic, polyamide, insulating varnish, or the like, over the metallic coating. Of course, the metal coating on the ball could be selected so that it is not affected by the gas flowing through the conduit 14. In such a case the protective coating on the ball would be unnecessary.

The electrical signalling in this embodiment works on a capacitor bridge principle, the circuitry of which is shown for the electrodes 38. A similar circuit (not shown) is also employed in conjunction with the electrodes 40. The circuit includes an AC generator 42, one side of which is connected in series to one electrode 38 through fixed resistor 44, and the other side of which is connected in series through variable capacitor 46 and variable resistor 48 to the other opposing electrode 38. A pair of fixed resistors 50 and 52 are connected in parallel with the generator 42, and a null meter 54 is connected in parallel with resistors 48 and 52 and capacitor 46. This is a well known, simple resistance, ratio bridge for measuring capacitance values.

In this case the capacitance of the electrodes 38 is measured without the ball being included therebetween. In this condition the bridge is balanced by varying the variable capacitor 46 and the variable resistor 48. When the circuit is balanced so that there is a null as indicated by the null meter 54, the following equations hold true.

$$Cx = \frac{R52}{R50} \times C46$$

and $$R44 = \frac{R50}{R52} \times R48$$

where

Cx = Capacitance between electrodes 38
C46 = Capacitance of capacitor 46
R52 = Resistance of resistor 52
R50 = Resistance of resistor 50
R44 = Resistance of resistor 44
R48 = Resistance of resistor 48

(resistance values are in ohms and capacitance values are in farads)

Thus, in the case when the flow ceases and the ball descends between the two electrodes 38, the previously balanced capacitance bridge is now upset by the position of the metallic coated ball between the electrodes 38 and the null meter 54 shows that the ball is now between the electrodes 38 indicating that the flow has been either reduced or cut off completely. A similar capacitor—bridge circuit (not shown) can be connected to the electrodes 40 to serve as an upper indicator. It shall be understood that in this instance the conduit 14 should preferably be formed of a suitable inert and insulative material such as plastic that will have minimal impact on the capacitive bridge. However, this is not to say that metallic conduits could not be used. In such a case suitable isolation of the electrodes must take place and the electrodes must be positioned such that only the metallized ball will alter the capacitance between the electrodes. In this case, the conduits 14 and the vanes 22, penetrating the interior of the body, would also be composed of an inert material. It should, of course, be understood that the electrodes 38 as well as the electrodes 40 could be thin conductive films deposited upon the seat 20 and the vanes 22 and coated with any suitable insulating material, such as a layer of polyamide, varnish, etc. It should also be understood that such capacitance indicators will only operate when the ball is capable of altering the capacitance between the plates, i.e., because it is formed of metal or if formed of a non-metal has a metallized coating thereon.

Also, signalling devices other than lamps or meters can be used if desired. For example, buzzers, bells or other audio devices could be employed. Further, other circuits or modifications of this circuit could be used to give different types of signals for different conditions, such as for example, one type of indicator for zero flow, another for maximum flow and yet another for a flow between zero and maximum.

What is claimed is:

1. A device for indicating gas flow through a conduit oriented in a generally vertical direction comprising:

a first section of said conduit having a substantially cylindrical inner surface with a first cross-sectional area;

a second section of said conduit disposed above said first section and having a substantially cylindrical inner surface with a second cross-sectional area;

a third section of said conduit connecting said first and second sections;

a ball disposed in said conduit and movable vertically responsive to the gas flow;

said third section of said conduit forming lower seating means for seating said ball when there is no gas flowing;

upper seating means in said second section, spaced from the third section and arranged to engage said ball;

circuit means including first electrical means in said third section and second electrical means at said upper seating means adapted to provide an electrical signal responsive to the co-action of said electrical means and the ball;

the internal cross-sectional area of the second section being sufficiently large, to compensate for the gas flow blocked by the upper seating means and the ball when said ball is seated in the upper seating means such that the cross-sectional area of the second section is at least equal to the sum of the cross-sectional areas of said first section, said upper seating means and said ball;

whereby an electrical signal is provided responsive to a given flow, and gas flow is not substantially restricted when the ball is engaging the upper seating means, thereby minimizing back pressure.

2. A device as in claim 1 wherein said third section comprises:

an inner surface in the shape of an inverted, truncated cone forming a check valve to prevent gas flow in the downward direction when said ball is seated in the lower seating means.

3. A device as in claim 2 wherein the upper seating means includes vane means.

4. A device as in claim 3 wherein said vane means include a plurality of circumferentially spaced vanes having tapered lower ends.

5. A device as in claim 2 wherein said first and second electrical means are normally open contact means, and said ball closes said circuit means.

6. A device as in claim 5 wherein said ball includes an electrically conducting surface to close said circuit means.

7. A device as in claim 2 wherein the conduit is insulating material and the first and second electrical means are spaced away from the inner surface and buried within the insulating material to prevent arcing and exposure to the gas.

8. A device as in claim 7 wherein the ball includes a metallic coating and a protective coating over the metallic coating to prevent arcing and exposure to the gas.

9. A device as in claim 2 wherein said first electrical means are flush with the inner surface of said conduit.

* * * * *